United States Patent [19]

Carn

[11] 4,244,563

[45] Jan. 13, 1981

[54] METALLURGICAL VESSEL WITH REMOVABLE TRUNNION PINS

[76] Inventor: William R. Carn, 1425 Brush Hill Cir., Naperville, Ill. 60540

[21] Appl. No.: 101,730

[22] Filed: Dec. 10, 1979

[51] Int. Cl.[3] ..... C21C 5/50

[52] U.S. Cl. ..... 266/246

[58] Field of Search ..... 266/246

[56] References Cited

U.S. PATENT DOCUMENTS

| | | | |
|---|---|---|---|
| 3,367,647 | 2/1968 | Dain | 266/246 |
| 3,376,029 | 4/1968 | Menu | 266/246 |
| 3,477,706 | 11/1969 | Puhringer | 266/246 |
| 3,951,390 | 4/1976 | Krause | 266/246 |
| 3,980,285 | 9/1976 | Enkner | 266/246 |
| 4,191,364 | 3/1980 | Montgomery | 266/246 |

*Primary Examiner*—P. D. Rosenberg

*Attorney, Agent, or Firm*—Merriam, Marshall & Bicknell

[57] ABSTRACT

A metallurgical vessel having a crucible supported by a trunnion having opposing axially aligned pins on which the vessel can rotate. At least one pin has a self-holding inward taper and fits in a tapered hole in the trunnion with an interference fit. The tapered pin can be inserted in the hole and be removed much easier than a cylindrical pin in a mating hole.

6 Claims, 3 Drawing Figures

METALLURGICAL VESSEL WITH REMOVABLE TRUNNION PINS

This invention relates to metallurgical vessels. More particularly, this invention is concerned with an improvement in metallurgical vessels, such as those used in the basic oxygen process for refining steel.

A metallurgical vessel widely used for refining molten metal comprises a crucible portion having an outer metal shell and a pair of coaxially aligned pins attached to a trunnion ring which runs circumferentially around the crucible portion. Each pin is located on the trunnion ring on an opposite side of the crucible portion. The outer metal shell is protected by a lining of suitable refractory material. The crucible is open at the top for receiving molten metal and also, in the case of steel production, for receiving an oxygen lance which is introduced into the interior of the vessel for refining the molten steel by oxidizing out impurities which are present. At the conclusion of the refining operation, the vessel is rotated about the axis of the pins and the molten contents is poured out. U.S. Pat. Nos. 3,262,690 and 3,358,984 are representative of patents which pertain to such metallurgical vessels.

It is customary for the supporting pins to be fixedly and nonremovably secured to the vessel trunnion ring. One way in which this is done is to shrink-fit a circular cylindrical pin into a circular cylindrical hole in the trunnion by heating the trunnion around the hole to expand it and cooling the pin to shrink it, putting the pin in the hole and letting the pin and trunnion reach room temperature. It has been found in practice, however, that the operating conditions to which the vessel is subjected cause damage to the pins, sometimes making it necessary for them to be replaced. In addition, improvement in drive mechanisms for rotating the vessel through one or more of the pins has made it desirable to be able to replace the pins fairly readily so as to permit modification of the ancillary equipment to upgrade metal refining in, and subsequent emptying of, the metallurgical vessel. There is accordingly a need for an improved metallurgical vessel which will permit one or both of the pins to be removably positioned in the trunnion ring so that subsequently one or both of the pins can be taken out and be repaired or be replaced with new pins of the same or modified design.

According to the present invention, there is provided an improved metallurgical vessel comprising a crucible portion having an outer shell, a circumferential trunnion portion attached to the crucible portion, and a pair of coaxially aligned pins, each located on an opposite side of the trunnion portion, in a pair of coaxially aligned holes, with one of each of the holes located on an opposite side of the trunnion portion, with the improvement comprising at least one of the holes having a circular cross-sectional configuration and tapering from a larger diameter on the outside of the trunnion portion to a smaller diameter on the inside of the trunnion portion and a pin having a self-holding tapered portion positioned in said tapered hole with an interference or shrink-fit. By suitably tapering the hole and the pin, an interference fit or shrink-fit is obtained which prevents the pin from axially rotating independently of the trunnion portion and crucible. Generally, it is unnecessary for the angle of the self-holding taper to exceed 2.5°, and usually the taper can be 1.0° to 1.5°. A self-holding taper is one where the frictional force between the mating surfaces is adequate to prevent axial displacement of the pin in the hole.

While only one pin and hole may be tapered it is generally advisable, at least in new construction, to have both pins and holes tapered.

To facilitate achieving the desired interference fit, the pin can be cooled to a low temperature, such as by inserting it in dry ice, and then placing the so-cooled pin in the vessel hole. As the cooled pin becomes warm it expands and thereby forms a very tight interference or shrink-fit. While it would also be possible to heat the portion of the trunnion surrounding each hole to thereby enlarge the hole before inserting the pin, this is generally unnecessary because cooling the tapered pin provides enough of a clearance for properly positioning the pin in the hole at room temperature so that the pin will subsequently expand into a shrink-fit against the hole wall upon warming to room temperature.

To aid in removal of each pin from the vessel, a circumferential groove is provided on the tapered portion of the pin, in the tapered hole, or in both. A fluid conduit is then extended to the grove, through the pin, so that a hydraulic fluid can be supplied to the groove from an outside source. The hydraulic fluid is fed under a pressure sufficiently high to cause the size of the tapered hole to enlarge slightly to thereby release the interference fit on the pin. The tapered pin may then be freed by use of a structural jacking frame placed on the outside of the vessel around the pin end so that the pin can be pulled axially outwardly to complete its release from the tapered hole. The structural jacking frame would be in the nature of a wheel puller widely employed in the removal of wheels, pullies and the like from shafts.

Removal of a tapered pin, as described, is much easier than removal of a cylindrical pin which would require heating the trunnion around the pin to expand the hole and/or cooling the pin to shrink it. Furthermore, a cylindrical pin would not be free of an interference fit until it is completely removed from the hole.

The invention will be described further in conjunction with the attached drawings, in which.

So far as is practical, the same elements in the various views of the drawings will be identified by the same numbers.

Figure 1:
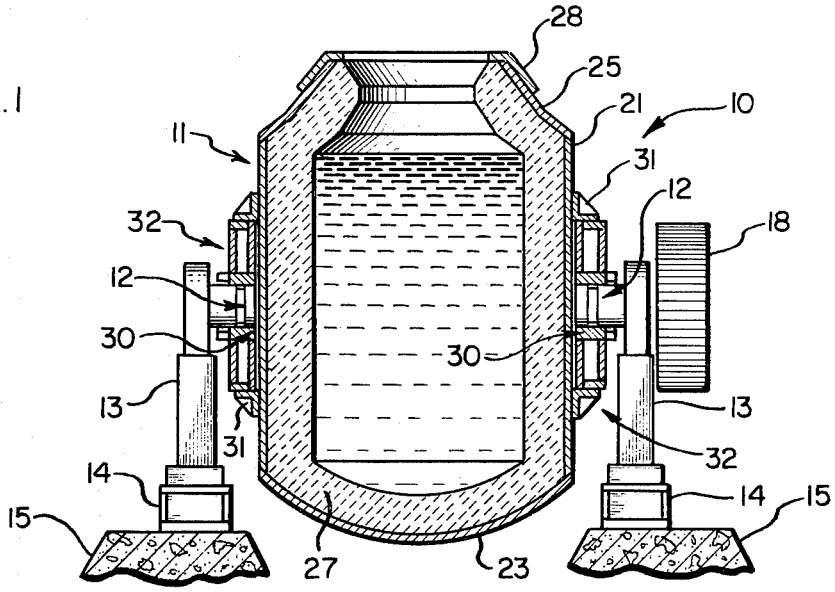
FIG. 1 is a front elevational view of a metallurgical vessel containing the improved trunnion pins.

Referring to FIG. 1, there is illustrated molten metal refining apparatus 10, comprising a metallurgical vessel 11 from opposite sides of which mounting pins 12, in trunnion ring 32, extend outwardly. Each pin is rotatably mounted on a pedestal 13 supported by a floor beam 14 resting atop foundations 15. One of the pins 12 is drivingly connected by gear 18 to a power means, not shown.

Vessel 11 has a crucible portion formed by a circular cylindrical metal shell 21, a dished bottom shell 23 and a top shell 25, largely conically shaped. The inside of the described metal shell portions is lined with a high temperature ceramic refractory material 27. Plate 28 around the mouth of the crucible portion holds the refractory lining in place when the vessel is rotated.

Each pin 12 is axially received in a tubular member 30 mounted on the side of the vessel in a trunnion ring 32.

Trunnion ring 32 is indirectly connected to the shell portion 21 by brackets 31, thereby permitting the crucible portion to expand and contract independently of the trunnion ring.

Figure 2:
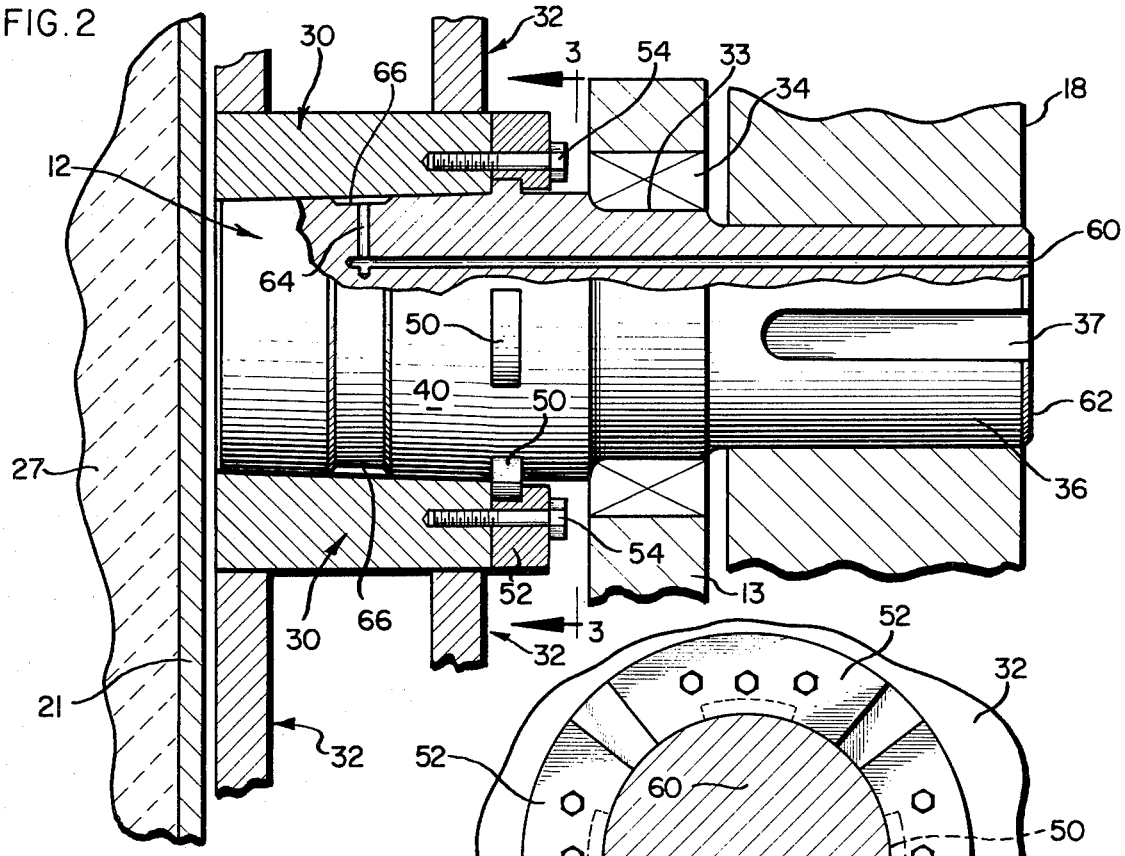
FIG. 2 is a sectional view taken through the pin on the right side of the vessel shown in FIG. 1.

As shown in FIG. 2, each pin 12 has a shoulder 33 which rides in a suitable bearing 34. One of the pins has an extension 36 on which gear 18 is mounted and secured against independent rotation by a key which fits in keyway 37.

The end 40 of each pin 12 which fits in tubular member 30 is slightly tapered as is the pin-receiving hole in member 30. The direction of taper is such that the diameter of the pin at the more-or-less central part is larger than the diameter at the end of the pin. A self-holding taper of about 1° to 1.5° is usually satisfactory.

The tapered hole in tubular member 30 is desirably made slightly smaller diametrically than the pin so that the tapered pin can be secured in place by a shrink-fit. With a pin of 36 in. diameter, the hole can be made about 0.02 to 0.04 in. smaller than the pin diameter. The pin to be inserted in the hole is cooled by placing it in dry ice, i.e., solid carbon dioxide. The cooled and shrunken pin is then inserted in the room temperature hole. Upon warming of the pin to room temperature, a secure shrink-fit is obtained which is adequate alone to keep the pin in rotational and axial location when the vessel is in service.

Figure 3:
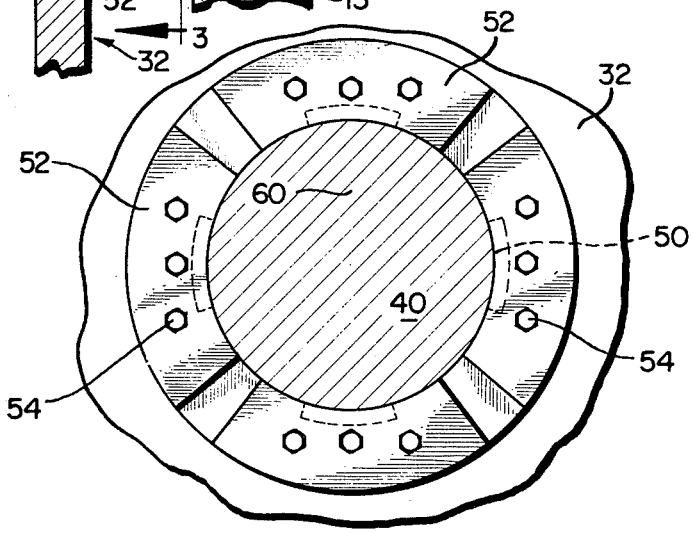
FIG. 3 is a sectional view taken along the line 3—3 of FIG. 2.

Even though the described shrink-fit is adequate alone to hold each tapered pin in place when the vessel is in service, a back-up pin retaining system is provided. This system includes a plurality of lugs 50 mounted on each pin 12 in a spaced-apart circumferential arrangement. FIGS. 2 and 3 show four lugs 50 on each pin but fewer or more lugs could be used as warranted by the size of the pin. Each lug 50 has a shoe 52 associated with it. The shoes 52 are removably secured to tubular member 30 by bolts 54 and thereby clamp the lugs 50 between the shoes and the end of the tubular member, thus preventing axial and rotational movement of the pin even if the shrink-fit of the pin in the hole proves inadequate.

Removal of the tapered pins 12 is sometimes required. Removal is desirably facilitated by employing means which includes releasing all or part of the pressure applied by the shrink-fit. Each pin 12 is accordingly provided with a hole 60, parallel to the pin axis, which extends from the pin outer end 62 to and communicates with radial hole 64 located about midway between the ends of the tapered portion. Radial hole 64 also communicates with trough 66 circumferentially positioned inbetween the ends of the pin tapered portion. Hydraulic liquid can be supplied under high pressure to trough 66 by holes 60 and 64 to thereby relieve pressure caused by the shrink-fit.

In the removal of a tapered pin 12 from the tapered hole in tubular member 30, the shoes 52 are first taken off and a jacking frame installed around the outer end of the pin to exert a tensile load on the pin relative to the vessel. The jacking frame employed will be in the nature of a wheel puller used to take a wheel or pulley off of a shaft. The jacking frame is first preloaded to its maximum compressive strain and then hydraulic fluid under pressure is supplied to trough 66 to relieve the shrink-fit. The preloaded jacking frame causes the pin to move axially outward until the compressive load on the jacking frame is too low to move the pin further. The jacking frame then is again preloaded, the trough 66 hydraulically pressurized and the pin moved out another increment. This process is repeated until the shrink-fit is cleared and neither the jacking frame nor the hydraulic pressure is needed further. No cooling of the pin or heating of tubular member 30 is required to remove the pin as described.

Although the embodiment illustrated by the drawings has the trough 66 in the pin, the trough can be located in the wall of the hole in tubular member 30, or a trough can be in both the pin and in the hole wall provided they are in communication with each other and hydraulic liquid supply hole 64.

The foregoing detailed description has been given for clearness of understanding only, and no unnecessary limitations should be understood therefrom, as modifications will be obvious to those skilled in the art.

What is claimed is:

1. In a metallurgical vessel comprising a crucible portion having an outer shell, a circumferential trunnion portion attached to the crucible portion, and a pair of coaxially aligned pins each located on an opposite side of the trunnion portion in a pair of coaxially aligned holes with one of each of the holes located on an opposite side of the trunnion portion, with the improvement comprising:

at least one of the holes having a circular cross-sectional configuration and tapering from a larger diameter on the outside of the trunnion portion to a smaller diameter on the inside of the trunnion portion, with said taper being of a self-holding nature; and a pin having a self-holding tapered portion positioned in said tapered hole.

2. The improvement according to claim 1 in which removable blocking means secures each pin in place in the hole against unwanted axial or rotational movement.

3. The improvement according to claim 1 in which a circumferential groove is located in the tapered hole surface or the tapered pin surface, and a fluid conduit extending from the groove, through the pin, to outside of the vessel.

4. The improvement according to claim 3 in which the fluid conduit extends, at least in part, approximately aligned with the pin axis from the pin outer end.

5. The improvement according to claim 1 in which the taper angle does not exceed 2.5°.

6. The improvement according to claim 1 in which both holes and both pins are tapered.

* * * * *